United States Patent [19]

Liautaud

[11] 4,190,840

[45] Feb. 26, 1980

[54] ANTENNA MOUNTING ADAPTOR

[75] Inventor: James P. Liautaud, Cary, Ill.

[73] Assignee: American Antenna Corporation, Elgin, Ill.

[21] Appl. No.: 860,234

[22] Filed: Dec. 13, 1977

[51] Int. Cl.[2] ..... H01Q 1/32

[52] U.S. Cl. ..... 343/715; 343/880

[58] Field of Search ..... 343/713, 715, 880, 711, 343/712

[56] References Cited

U.S. PATENT DOCUMENTS

| | | | |
|---|---|---|---|
| 3,056,570 | 10/1962 | Slavin | 343/715 |
| 3,299,429 | 1/1967 | McMullin | 343/803 |
| 4,038,661 | 7/1977 | Nolte | 343/715 |
| 4,090,030 | 5/1978 | Lacasse | 343/715 |

FOREIGN PATENT DOCUMENTS

| | | | |
|---|---|---|---|
| 1246871 | 10/1960 | France | 343/713 |

*Primary Examiner*—Eli Lieberman

*Attorney, Agent, or Firm*—Lockwood, Dewey, Alex & Cummings

[57] ABSTRACT

A mounting adaptor for mounting a mobile antenna to an external frame member such as the support arm of a side view mirror or the frame of a carrier rack, or to the rain gutter of a motor vehicle roof, includes a housing from which an adjustable band clamp extends. When the adapter is mounted on an external frame member the band clamp is attached at its free end to the housing and drawn tight around the frame member. When the adapter is mounted on a rain gutter an integral mounting shoe projecting from the housing is seated under the gutter and the adaptor housing is drawn toward the gutter by the band clamp so as to secure the mounting shoe in position.

10 Claims, 9 Drawing Figures

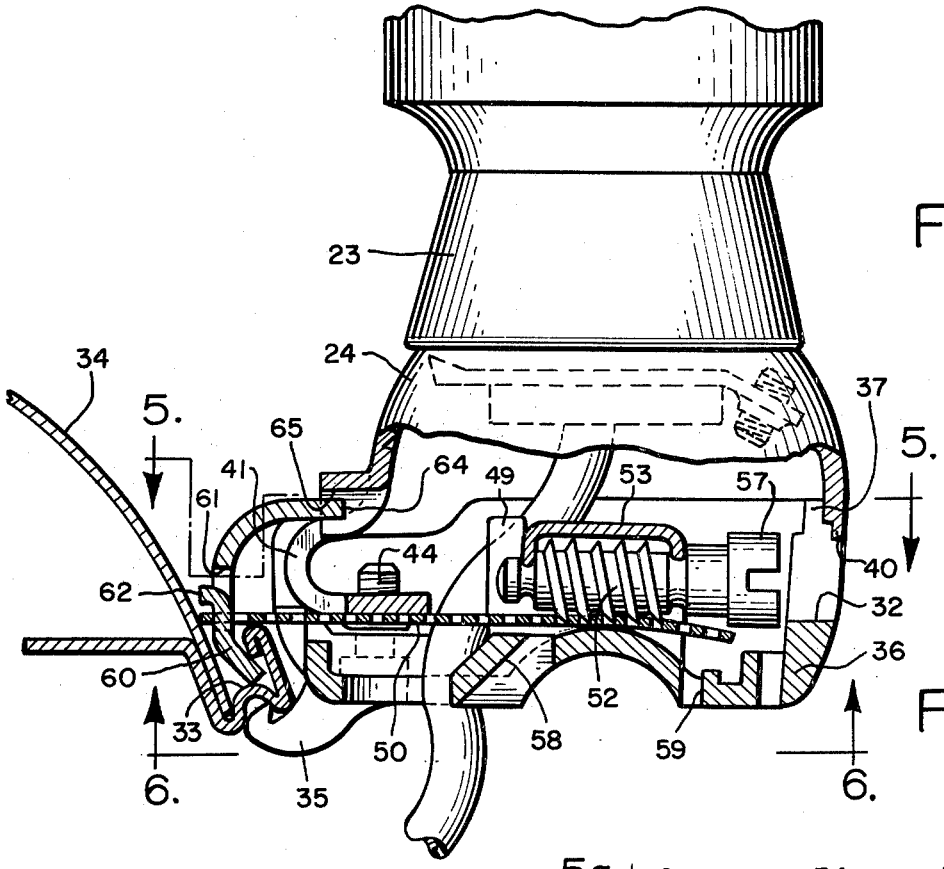
FIG. 4
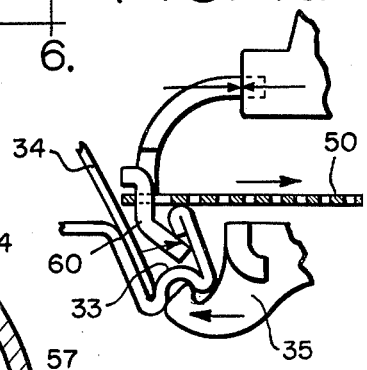
FIG. 4a
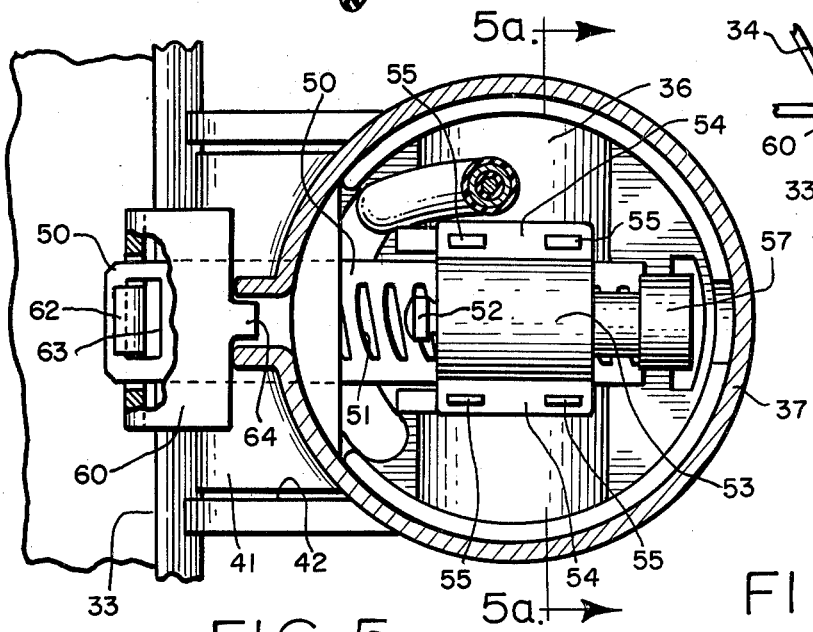
FIG. 5
FIG. 5a
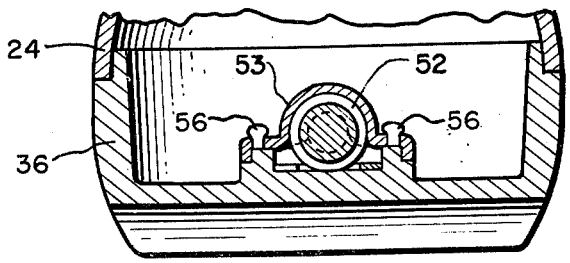

ANTENNA MOUNTING ADAPTOR

BACKGROUND OF THE INVENTION

The present invention relates generally to antenna mounting adaptors, and more particularly to an adaptor for mounting a mobile antenna to various exterior surfaces on a motor vehicle, including external support members such as a side view mirror or a carrier rack, or to the rain gutter commonly found on such vehicles.

In recent years the increased use of mobile communications equipment, particularly that intended for use on the Citizens' Band, has created a need for high frequency antennas suitable for mounting on the exterior of automobiles or other vehicles. To facilitate removal of the antennas from the vehicles when the equipment is not in use, and to avoid having to permanently mark or modify the exterior of the vehicle by drilling mounting holes, such antennas are often temporarily or removably mounted, typically to the lip or edge of a movable body panel, such as a trunk lid, or to a roof edge rain gutter, or to an exterior frame member, such as a luggage rack or a mirror support member.

To avoid the need for stocking different types of antenna base assemblies for each type of installation, it is desirable that the base of a mobile antenna accommodate as many different types of installations as possible, including the trunk lip, rain gutter, luggage rack, and side view mirror installations outlined above. Moreover, it is also desirable that the base be aesthetically pleasing when installed, and that the antenna be easily removable or demountable by the owner for safe-keeping when the vehicle is left unattended.

Accordingly, the object of the present invention, generally stated, is the provision of a new and improved adaptor for mounting a mobile antenna to the exterior of a motor vehicle.

Another object of the present invention is the provision of an inexpensive, aesthetically pleasing, and mechanically sound adaptor which provides a semi-permanent mounting for a mobile antenna on an automobile or the like.

SUMMARY OF THE INVENTION

The invention is directed to an adaptor for mounting a mobile antenna on an external frame member. The adaptor includes a housing adapted to receive in mating engagement the base of the antenna, and fastener means including an adjustable band member extending from the housing. Means are provided on the housing for receiving the free end of the adjustable band member to form a closed loop of adjustable girth for encircling the frame member. Means are also provided on the free end of the adjustable band for engaging the inside of the gutter, and on the housing for engaging the underside of the gutter, whereby the adaptor can be alternatively mounted on a rain gutter.

BRIEF DESCRIPTION OF THE DRAWINGS

The features of the present invention, which are believed to be novel, are set forth with particularity in the appended claims. The invention, together with the further objects and advantages thereof, may best be understood by reference to the following description taken in conjunction with the accompanying drawings, in the several figures of which like reference numerals identify like elements, and in which:

FIG. 4 is an enlarged cross-sectional view of the base portion of the antenna of FIG. 2 taken along line 4—4 of FIG. 2.

FIG. **4*a* is an enlarged cross-sectional view similar to FIG. 4** showing the engagement between the adaptor housing and the rain gutter.

FIG. 5 is a cross-sectional view of the housing of the adaptor taken along line 5—5 of FIG. 4.

FIG. **5*a* is a cross-sectional view of the adaptor housing taken along line 5*a*—5*a* of FIG. 5**.

Figure 6:
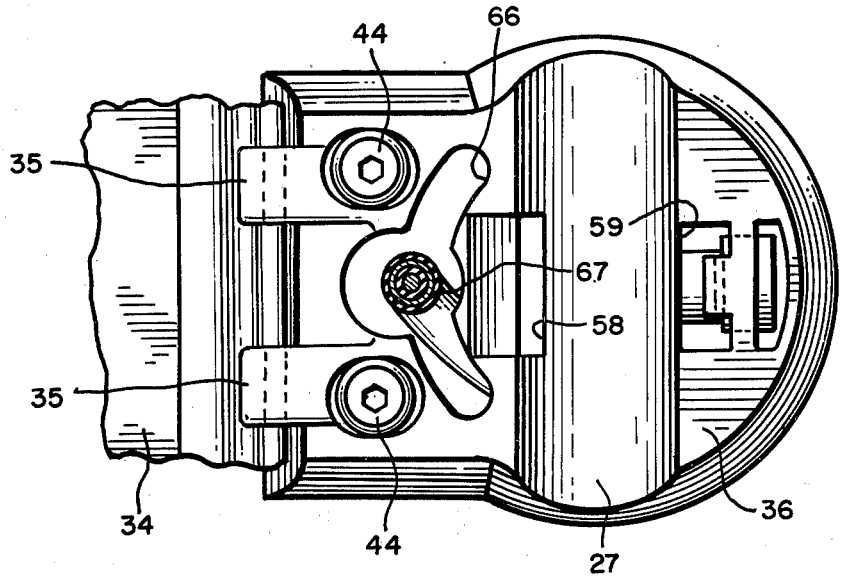

FIG. 6 is a bottom plan view of the adaptor taken along line 6—6 of FIG. 4.

Figure 7:
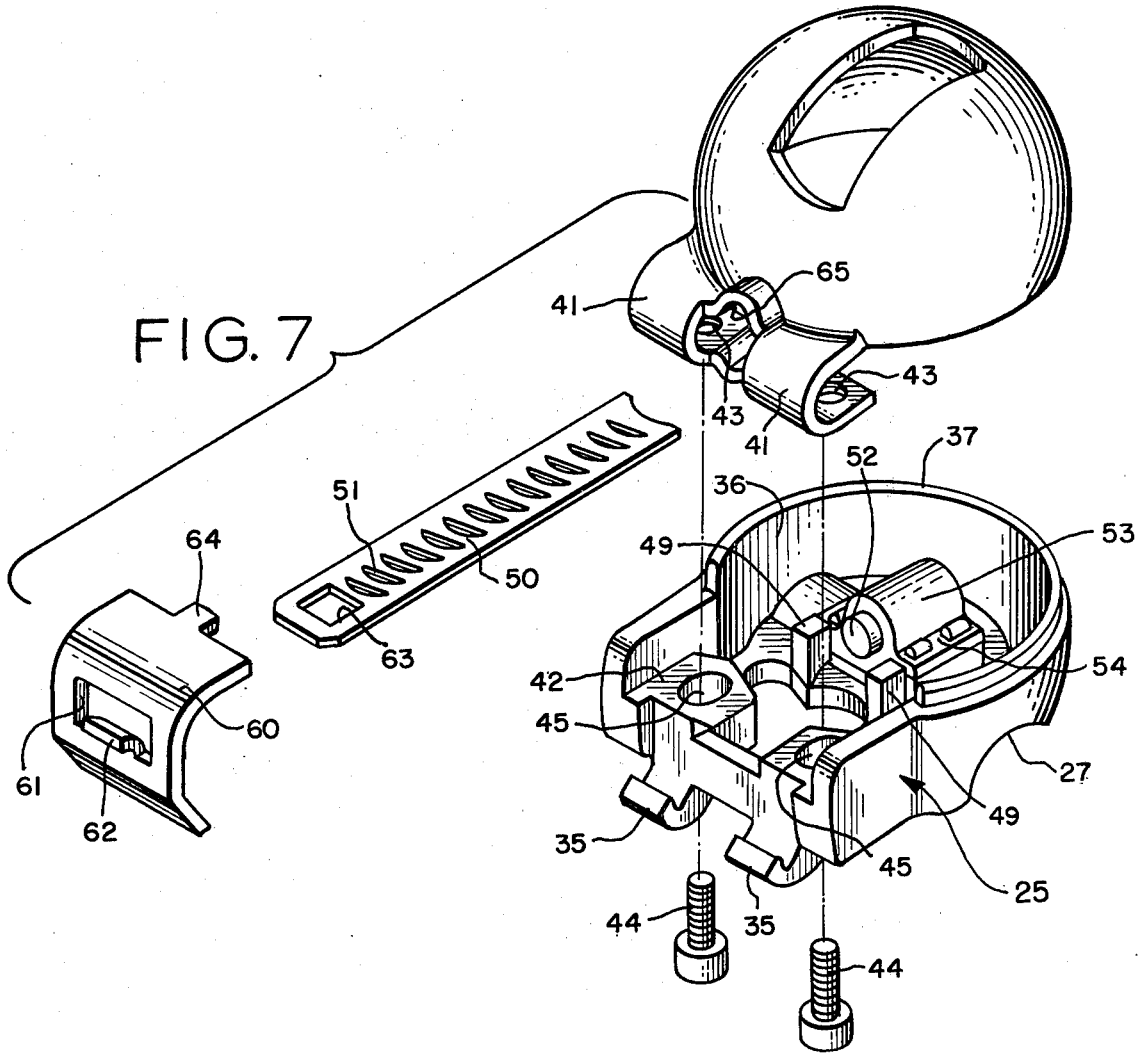

FIG. 7 is an enlarged exploded perspective view of the adaptor and base of the antenna showing the adjustable clamp band and retaining clip at the end thereof.

DESCRIPTION OF THE PREFERRED EMBODIMENT

Figure 1:
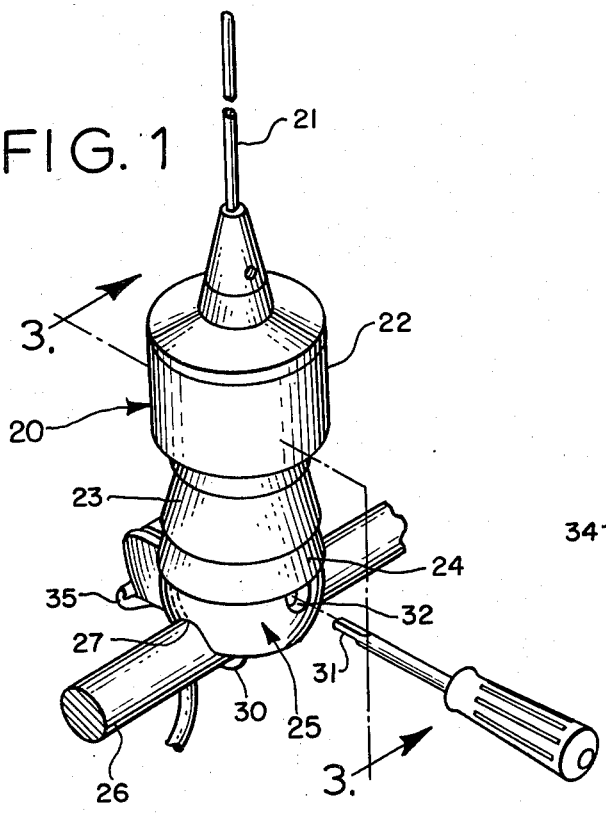
FIG. 1 is a perspective view of a mobile antenna wherein the adaptor of the present invention is utilized to mount the antenna on an external support member, in this case a tubular member comprising a portion of a luggage rack.
Figure 2:
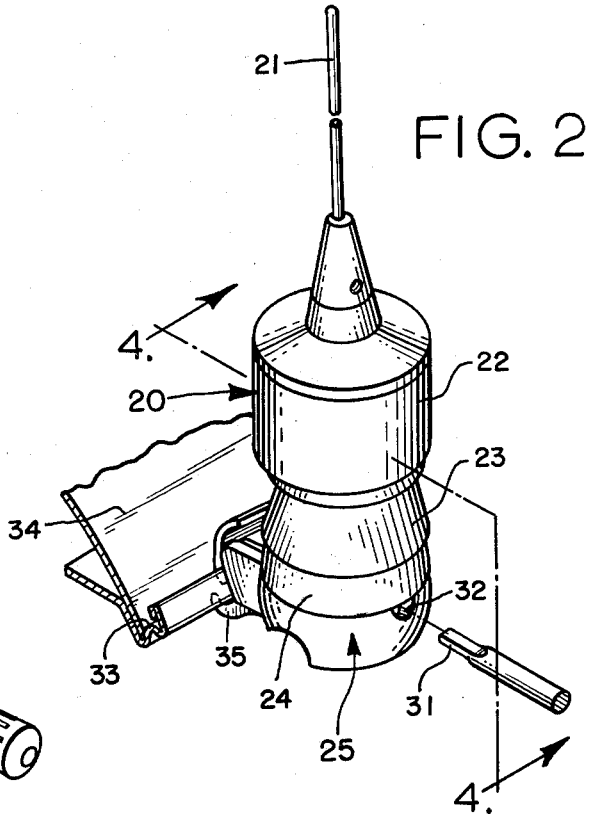
FIG. 2 is a perspective view of a mobile antenna wherein the adaptor of the present invention is utilized to mount the antenna to the rain gutter of a motor vehicle.

Referring to FIGS. 1 and 2, a mobile antenna 20 for use in conjunction with a mounting adaptor constructed in accordance with the invention includes a vertical radiating portion 21 formed of spring wire, and a base portion 22 from which the radiating portion extends for a predetermined length. The radiating portion is electrically tuned by a coil (not shown) within the base portion, and the length of the radiating portion is preferably adjustable to permit fine tuning of the antenna. Base portion 22 is releaseably mounted to a skirt member 23 which coacts with a hemisphere-shaped shell member 24 to allow tilting of the antenna to a desired angular position. Reference is made to the co-pending applications of James P. Liautaud, "Mobile Antenna", Ser. No. 860,236; "Mobile Antenna with Adjustable Radiating Element", Ser. No. 860,245; "Mobile Antenna Mounting Assembly", Ser. No. 860,237; and "Mobile Antenna Including Quick Release Mounting", Ser. No. 860,247, filed concurrently herewith, for a detailed description of the antenna and mounting arrangements.

The hemisphere-shaped shell member 24 of the antenna includes provisions for mounting the antenna directly on the edge of a flat body panel, such as the rear trunk lid of an automobile, and the antenna can be mounted in this manner without the use of an adaptor. However, where the antenna is to be mounted on an external support member, such as the frame 26 of a side view mirror, as shown in FIG. 1, or to an automobile roof rain gutter, as shown in FIG. 2, the bottom of the shell member 24 is attached to an adaptor 25.

Basically, when antenna 20 is mounted on a frame member, an adjustable band clamp 30 within the adaptor is extended around the frame member and tightened by means of a screwdriver 31 inserted through an access aperture 32 in the adaptor housing. When the antenna is mounted on the rain gutter 33 of a motor vehicle roof 34, as shown in FIG. 2, the adaptor is retained by means of integral shoe portions 35 engaging the underside of the rain gutter, and the clamp band assembly 30, which now engages the inside of the gutter so as to maintain the shoes in engagement with the motor vehicle.

As shown in FIGS. 3–7, adaptor 25 comprises a housing 36 which includes an annular rim 37 dimensioned to receive in mating engagement the annular bottom edge 40 of the antenna base member 24. As the bottom edge 40 fits on rim 37, a C-shaped clip portion 41 of member 24, which extends outwardly of the base at the rear thereof, fits into a channel 42 formed in a squared end portion of the housing. The clip portion 41 includes a pair of threaded apertures 43 through its outer ends through which screws 44 may be threaded to secure the antenna base in the manner of a C-clamp to the edge of an automobile trunk lid or other body panel. When the antenna base 24 is mounted on adaptor housing 36, apertures 43 align with a second pair of apertures 45 in the rectangular end portion of the adaptor housing. Screws 45 are then inserted through apertures 45 and into engagement with apertures 43 so as to secure the base member to the adaptor housing.

Figure 3:
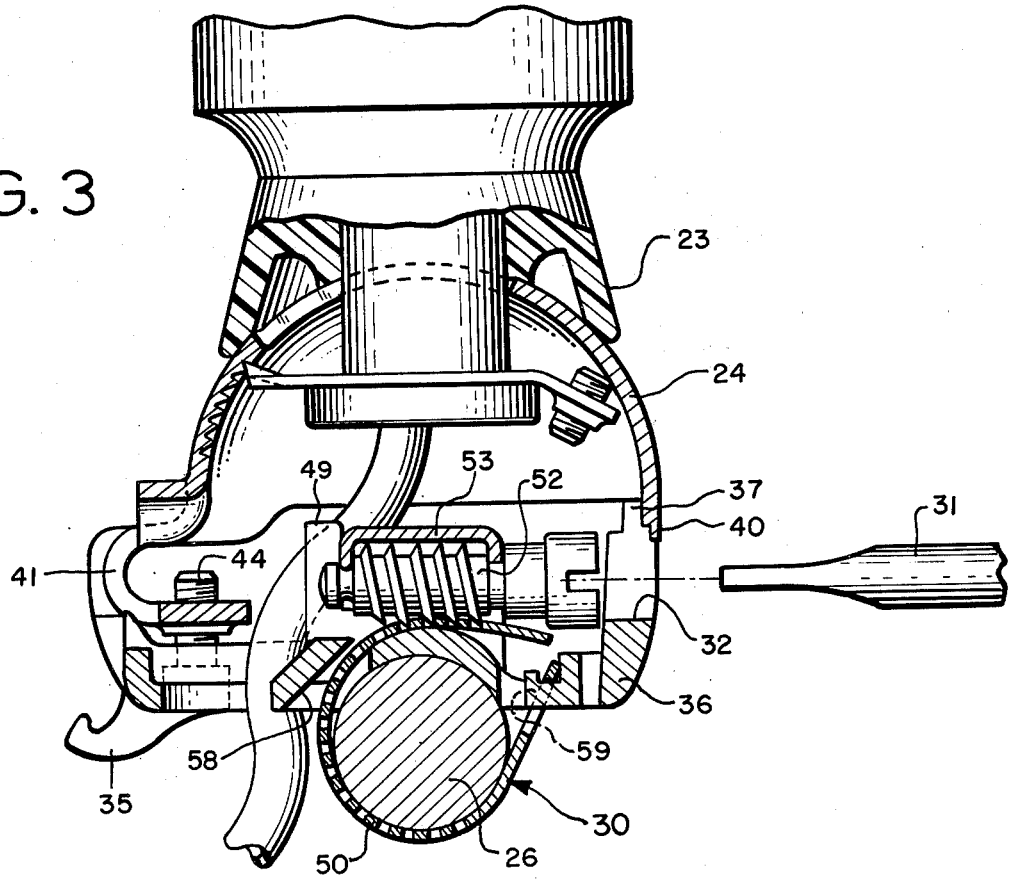
FIG. 3 is an enlarged cross-sectional view of the adaptor and base portion of the antenna of FIG. 1 taken along line 3—3 of FIG. 1.

Referring to FIG. 3, when the adaptor is configured for mounting to an external frame member, the adjustable band clamp assembly 30 is arranged in the form of a closed loop around the supporting structure. As the clamp is tightened, the girth of the loop is decreased and the supporting structure is tightly engaged.

The band clamp assembly 30 may be of conventional design and construction, consisting of a stainless steel band 50 having a plurality of evenly spaced slot-like apertures 51. The apertures are engaged by a screw member 52 which is mounted for free rotation within a band housing 53. The band housing is mounted to adaptor housing 36 by means of a pair of integral mounting flanges 54 which extend along either side of the band housing. Each of these flanges includes a pair of slot-shaped apertures 55 arranged to receive upwardly projecting mounting tabs 56 (FIG. 5*a*) within the adaptor housing to secure the band housing in position. Projections 49 prevent the band housing from being pulled forward. The screw member 52 includes a slotted head 57 aligned with access aperture 32. To adjust the girth of the clamp a screwdriver is inserted through the access aperture and screw member 52 is turned in an appropriate direction to either extend or withdraw the adjustable end of the band.

When attached to an external frame member 26, band 50 extends through an aperture 58 in the bottom wall of the adaptor housing, around the frame member, and back into the adaptor housing through an aperture 59. Screw 52 is turned so as to engage slots 51 on band 50 and thereby draw the band tightly upon member 26. It should be noted that band 50, because of its inherent flexibility, can extend around a wide variety of frame members, whether round, oval, or rectangular in cross-section.

Referring to FIGS. 4–7, when the mounting adaptor is configured to mount the antenna to a rain gutter the free end of band 50 is attached to a C-shaped retaining clip 60. As best seen in FIG. 7, the clip member includes a centrally located aperture 61 having an outwardly projecting tab portion 62 along one margin thereof. This tab portion extends through an aperture 63 in the free end of the band, thereby locking the clip member and band together.

The band is threaded into screw housing 53 as before, and drawn taut until retaining clip 60 is securely seated within gutter 33 as shown, with its bottom end engaging the bottom of the gutter and its top end engaging housing 28. To improve the engagement between the retaining clip and housing 28, a projecting tab portion 64 may be provided on the top end of the clip and a recess 65 may be provided on the housing to receive the tab portion.

As shown in FIG. 4*a*, the effect of tightening band 30 is to draw the bottom end of the clip against the inside wall of the rain gutter, thereby causing the adaptor mounting shoe to be drawn against the underside of the gutter. The result is a secure mounting between the adaptor housing and the motor vehicle. Since the retaining clip is free to pivot with respect to the end of band 50, and since the ends of the two mounting shoes 35 are upwardly curved, a wide variety of gutter shapes and sizes can be accommodated by the adaptor.

As shown most clearly in FIG. 6, an aperture 66 may be provided in the bottom wall of adaptor housing 36 to provide a passage for the coaxial cable 67 which connects the antenna to associated equipment.

Thus, the adaptor of the invention provides means for mounting a mobile antenna to a wide variety of support surfaces on a motor vehicle, including external frame members and rain gutters. The adaptor is convenient to install, requiring only a simple screwdriver adjustment to secure the antenna in position. Furthermore, because of its simple design and minimum number of component parts, the adaptor is reliable and economical to manufacture.

While a particular embodiment of the invention has been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

I claim:

1. An adaptor for mounting a mobile antenna on a vehicle gutter or the like, said adapter comprising:

a housing adapted to receive in mating engagement the base portion of the antenna;

fastener means for mounting said housing to the gutter including an elongated band having first and second ends, said housing including a sidewall with opening means in said sidewall, the first end of said band being received within said housing through said opening means;

user-adjustable means within said housing for engaging said first end of said band to draw said first end into said housing, said second end of said band including attachment means for positioning in the interior of said gutter;

said sidewall further including a shoe for engagement with the underside of the gutter, whereupon adjustment of said user-adjustable means draws the housing and shoe tightly into engagement with said gutter.

2. An adapter for mounting a mobile antenna in accordance with claim 1 wherein said attachment means at the second end of said band is a retaining clip with one end receivable into said gutter and another end receivable into slotted means in said housing for aligning said housing with said gutter as said housing is drawn toward said gutter.

3. An adapter for mounting a mobile antenna in accordance with claim 1 wherein said shoe is generally hook-shaped and includes an upwardly extending hook portion for engaging the underside of said gutter.

4. An adapter for converting a trunk deck antenna mount to a multi-purpose vehicle mount, said adapter comprising:

a housing coupled to said trunk deck mount;

said housing including a bottom portion with a shoe portion on one side and with an underlying support surface portion;

a flexible band with medial engagement means and first and second end portions;

screw-adjustment means in said housing for engaging said medial engagement means, said screw adjustment being externally operated for driving said band to a tension operative position.

5. An adapter in accordance with claim 4 mounted on a support rod with said underlying support surface nesting on said rod, said first end of said band fixed within said housing, said second end of said band looped over said support rod to extend into said housing, said screw-adjustment means tightening said loop around said support rod.

6. An adapter in accordance with claim 4 mounted to a vehicle gutter, said shoe portion engaging the underside of said gutter, said second end of said band including attachment means engaged interiorly of the gutter, said screw-adjustment means drawing said band into said housing, whereby said shoe portion is tightly engaged against said rain gutter.

7. An adapter in accordance with claim 4 wherein said housing includes opening means in communication with said screw-adjustment means, said housing further including band attachment means, said band attachment means and said opening means being located on opposite sides of said underlying support surface.

8. An adapter in accordance with claim 4 further comprising fastener means removably attachable with said band at a location exterior of said housing.

9. An adapter in accordance with claim 8 wherein said fastener means comprises a retaining clip receivable into a vehicle gutter.

10. An adapter in accordance with claim 7 wherein said band has an aperture at one end, said band attachment means comprising a tab portion dimensioned to extend into said aperture.

* * * * *